United States Patent [19]

Strenczewilk

[11] 4,083,482

[45] Apr. 11, 1978

[54] CUP CADDY

[76] Inventor: Anthony F. Strenczewilk, 72 Knapp Ave., Rochester, N.Y. 14609

[21] Appl. No.: 440,964

[22] Filed: Feb. 11, 1974

[51] Int. Cl.[2] ..... B65D 71/00

[52] U.S. Cl. ..... 224/45 G; 211/59.1; 206/502

[58] Field of Search ..... 224/45 R, 45 G, 48 F; 211/41, 49 S, 59, 49 R, 49 D, 125 R, 59.1; 312/43; 206/499, 500, 501, 502, 303, 503, 509; 214/8 R, 8.5 R; 229/1.5 H

[56] References Cited

U.S. PATENT DOCUMENTS

| | | | |
|---|---|---|---|
| 1,167,934 | 1/1916 | Roth | 224/45 G |
| 2,030,465 | 2/1936 | Nist | 206/303 |
| 2,206,083 | 7/1940 | Feibelman | 224/45 G |
| 2,598,995 | 6/1952 | Graff | 224/45 G |
| 2,932,983 | 4/1960 | Laviana et al. | 211/59 |
| 2,948,452 | 8/1960 | Grogan et al. | 229/1.5 H |
| 2,973,108 | 2/1961 | Gable | 214/8.5 R |
| 3,280,987 | 10/1966 | Steinbock | 211/59 |
| 3,497,057 | 2/1970 | Traner et al. | 206/499 |
| 3,788,487 | 1/1974 | Dawson | 211/59 |
| 3,792,822 | 2/1974 | Underhill | 211/59 |

FOREIGN PATENT DOCUMENTS

| | | | |
|---|---|---|---|
| 1,429,226 | 2/1969 | Germany | 229/1.5 H |

*Primary Examiner*—Trygve M. Blix
*Assistant Examiner*—Kenneth Noland
*Attorney, Agent, or Firm*—Samuel R. Genca

[57] ABSTRACT

A cup caddy for vertically stacking and transporting cup holders and cup refills therefor in a predetermined side by side arrangement is shown. In accordance with the invention, the cup holders are uniformly alignable upon a vertical post having diametrically opposite longitudinal keyways which coact with at least one key internally disposed within a through-opening in each of the cup holders. The cup caddy includes a receptacle having a longitudinal vertical slot for containing the refills therein and providing an access thereto for the cup holders. The receptacle and post are mounted on a base in a side by side relationship and are adapted to receive a cover thereover.

6 Claims, 12 Drawing Figures

CUP CADDY

BACKGROUND OF THE INVENTION

1. Field of the Invention

The present invention relates generally to a commercial or household article and more particularly to a cup caddy for stacking and transporting cup holders and disposable cup refills therefor.

2. Prior Art

Cup holders and disposable cup refills of the type which are assembled just prior to use as drinking cups are well known to those skilled in the art. The cup refill is disposed after use but the cup holder may be reused since the cup refill is the only part which comes in contact with the user's mouth. This type of cup is sanitary, economical and convenient to use. It is also a labor saving device since the refill is disposable. A problem of long standing however in the use of this type of cup is that the cup holders are difficult to organize in a neat, uniform stack and the cup refills, if removed from their original carton, lose their original sanitary condition. Accordingly, there exists a pressing need for a cup caddy for uniformly stacking and transporting the cup holders and cup refills in a sanitary condition.

SUMMARY OF THE INVENTION

Briefly described, a cup caddy in accordance with a preferred embodiment of the invention for uniformly stacking, transporting cup holders and cup refills comprises a base, a vertical post mounted on the base for stacking a plurality of cup holders thereon and a refill means mounted on the base for containing a plurality of cup refills in stacked relationship along a vertical axis corresponding to the cup axis. The refill means includes a slot, a recess which provides an access to the cup refills along the vertical axis so that each cup holder may be assembled to the top cup refill on the stack of cup refills, thus all the unused refills are kept in a sanitary condition and are readily accessible. The cup holders may also be uniformly aligned on the post by the coaction of at least one tooth within the cup holder and a corresponding longitudianl keyway on the post.

BRIEF DESCRIPTION OF THE DRAWINGS

The invention will be better understood upon consideration of the following detailed description taken together with the accompanying drawings in which like elements in various figures have like designations and in which.

DESCRIPTION OF THE PREFERRED EMBODIMENT

Figure 1:
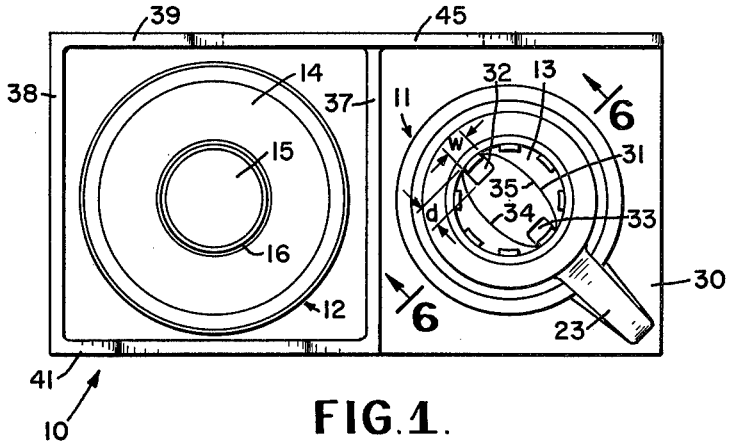
FIG. 1 is a top view of a cup caddy in accordance with a preferred embodiment of the invention.
Figure 3:
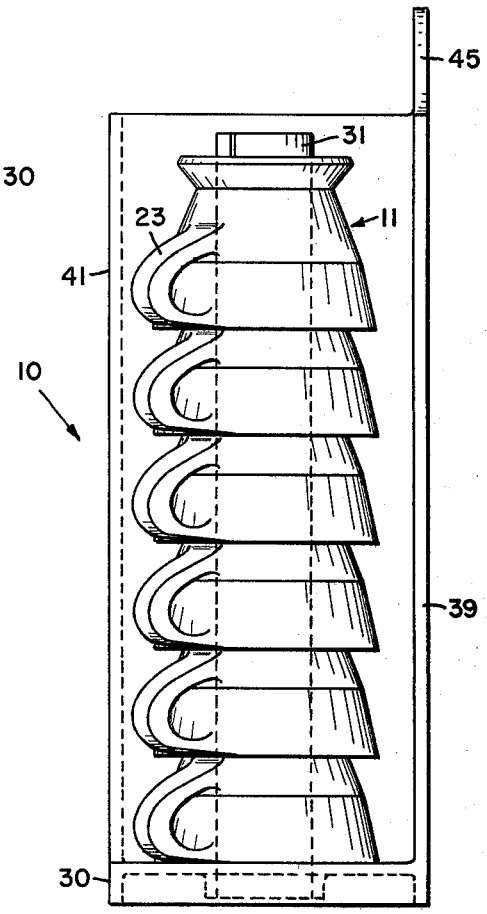
FIG. 3 is a right end view of the cup caddy of FIG. 1.
Figure 2:
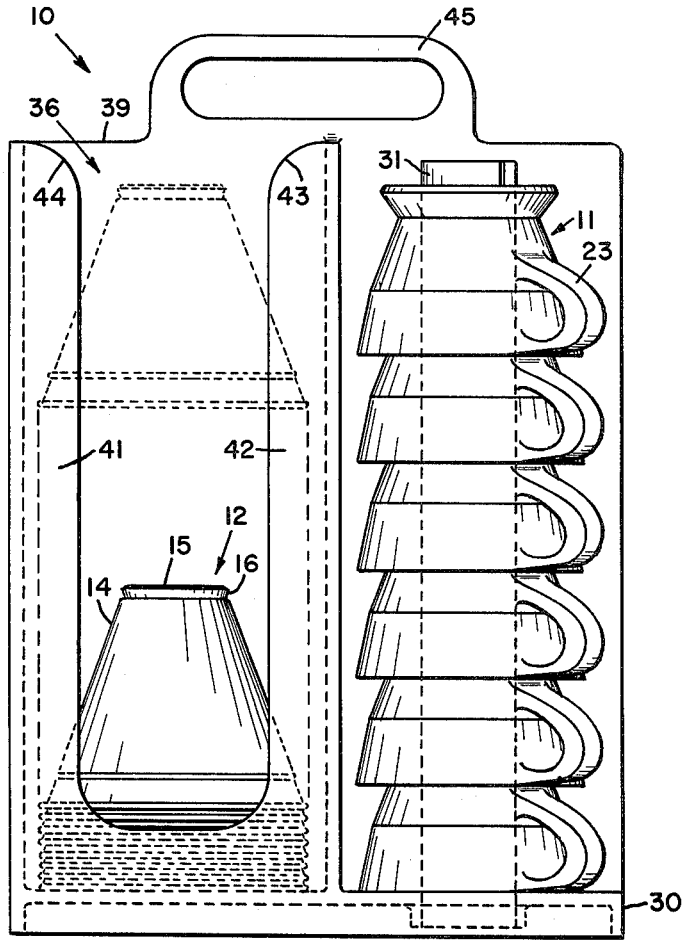
FIG. 2 is a front view of the cup caddy shown in FIG. 1 with plastic cup refills and cup holders stacked in accordance with the invention.
Figure 4:
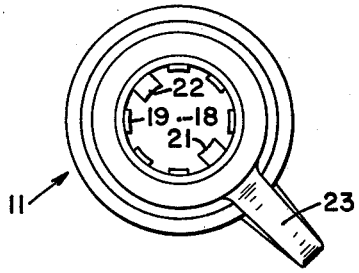
FIG. 4 is a bottom view of a cup holder of the type which may be stacked within the cup caddy of the present invention.

Referring first to FIGS. 1, 2 and 3 of the drawing, a cup caddy 10 in accordance with a preferred embodiment of the invention is shown. The cup caddy 10 is particularly adapted for use with cup holders 11 (FIG. 4) and cup refills 12 of the type which are assembled just prior to use by inserting the cup refill 12 into a recessed through-opening 13 in the cup holder 11. The assembled cup holder 11 and cup refill 12 form a drinking cup of the type which is manufactured by different manufacturers under various trademarks, one of which is Solo Cozy Cups, manufactured by and a trademark of Solo Cup Co., Chicago, Ill. The cup refill 12 includes a thin wall 14 conically shaped body, truncated at the bottom 15 with an annular detent recess 16 thereat to form a container for hot or cold liquids. The cup refills 12 nest one on top of the other as shown in FIGS. 1 and 2. The cup holder 11 is shown in greater detail in FIGS. 4 and 6. The cup holder 11 includes a relatively thin circular wall 17 disposed about a cup axis 18 forming the recessed through-opening 13 for receiving the cup refill 12 therein. The cup holder 11 includes a plurality of keys 19 internally disposed in the opening 13, which keys 19 coact with the annular detent recess 16 to hold the cup refill 12 to the cup holder 11. In one type of cup holder, the keys such as keys 21, 22 may be longer than the other keys 19 but all the keys have a uniform width as shown in FIG. 4. The cup holder 11 includes a handle 23.

Figure 6:
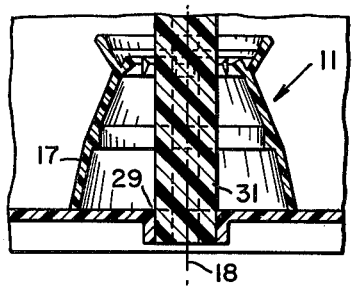
FIG. 6 is a partial fragmentary cross-sectional view taken along line 6—6 of the cup caddy of FIG. 1 to show details of the invention.

The cup caddy 10 includes a substantially flat base 30 of a generally rectangular shape in plan view and a post 31 normal to the base 30 for stacking the cup holders 11 thereon. The post 31 has two longitudinal keyways 32, 33 each of which has a width *w* and a depth *d* to simultaneously receive the keys 21, 22 or any pair of diametrically opposed keys 19. The post 31 has a reduced cross-sectional area between the opposite disposed keyways 32, 33 defined by post wall 34, 35 so as to provide a clearance from the keys 19. Thus, the post 31 and keyways 32, 33 provide a means for uniformly stacking the cup holders 11 thereon with the cup holder handles 23 vertically aligned in a neat, orderly manner. The length of the post 31 determines the number of cup holders 11 which can be stacked on the post 31. As seen in FIGS. 2 and 3, the post 31 can accommodate six cup holders 11. The post 31 is fixed to the base 30 in a bore 29 of the base 30 and is supported by a retaining wall 28 as shown in FIG. 6.

The cup caddy 10 also includes a refill container means 36 fixed to the base 30 for holding the cup refills 12 in a nesting position, bottom 15 of each refill being disposed in an upward direction as shown in FIG. 2. The refill container means 36 includes vertical side walls 37, 38, a rear wall 39 and a front wall 41 projecting upwards from the base 30 to laterally confine the cup refills 12 therebetween. The front wall 41 includes a slotted opening or recess 42 for receiving the cup holder handle 23 vertically along a longitudinal axis of the recess 42. Thus, the cup holder 11 may be placed over the cup refill 12 with the handle 23 extending through the recess 42 for engagement with cup refill 12. The recess 42 has radii at 43, 44 so as to provide a lead for the handle 23. The rear wall 39 extends along the rear of the cup caddy 10 and is fixed to the base 30 to provide a rigid construction and also an enclosure for the cup holders 11 with side wall 37. The cup caddy 10 also includes a caddy handle 45 for conveniently carrying the cup caddy 10. The refill container means 36 is proximal to the post 31 on the base 30.

Figure 5:
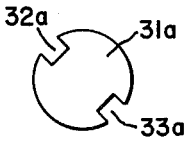
FIG. 5 is an end view of a post utilized in the present invention.

While the post 31 is desirable, other posts having one or more keyways may be used without departing from the invention. For example, the round post **31*a* shown in FIG. 5 may be used instead of the post 31 in the cap caddy 10. The post 31*a* has a round diameter and longitudinal keyways 21*a* and 22*a* similar to keyways 21 and 22, but the diameter of the post 31*a* is of a small enough size to fit the through-opening 13 and thus serves the same function as the post 31**.

Figure 9:
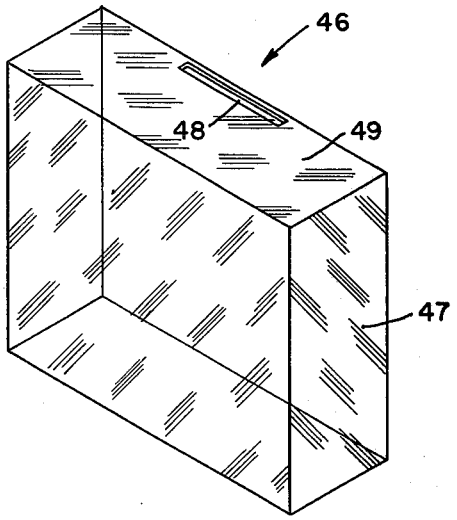
FIG. 9 is a perspective view of a cover for a cup caddy shown in FIG. 10.

FIG. 9 shows a cover 46 which may be used in combination with the cup caddy 10. The cover 46 may be molded of clear plastic having a relatively thin wall 47 to fit over the rectangular base 30 of the cup caddy 10. A slotted opening 48 is provided on the top 49 to receive the handle 45 of the cup caddy 10. The cover 46 not only provides a dust cover for the cup caddy 10 and the cup holders 11 and refills 12, but also may be used as part of a shipping means for the cup caddy 10 and will also provide an attractive display.

In the operation of the cup caddy 10, cup holders 11 may be placed over the post 31 in a neat, orderly, aligned arrangement when the keys 21 and 22 of the cup holder 11 engage the keyways 33 and 32 respectively, all the handles 23 of the cup holders 11 are disposed in vertical alignment. The cup refills 12 can be placed within the refill container means 36 in nesting relationship with the bottom 15 disposed in an upward direction. The cup refills 12 are thus placed in readiness for a cup holder 11 which may be placed over the cup refill 12 while the handle 23 of the cup holder 11 may move vertically along recess 42. With this movement, the holder 11 may come in contact with the cup refill 12 and when the keys 19, 21 and 22 engage the annular recess 16 of the cup refill 12, the cup refill 12 is assembled to the cup holder 11 ready for drinking use. It may now be seen that the cup refill 12 and the cup holder 11 are kept in a sanitary condition and are neatly arranged within the cup caddy 10.

Other modifications of the combination of the post 31 and refill container means 36 may be made without departing from the invention. For example, referring now to FIG. 8, a cup caddy 80 having four posts 31 and two refill container means **36*a* for carrying additional cup refills 12 and cup holders 11 is shown. The cup caddy 80 is similar to the cup caddy 10 and functions in the same manner as the cup caddy 10. The cup caddy 80 of course includes a larger base 30*a* to accommodate the four additional posts 31 and the two refill container means 36. The cup caddy 80 includes a handle 45*a* which is conveniently placed along a wall 39*a* for carrying the cup caddy 80**.

Figure 7:
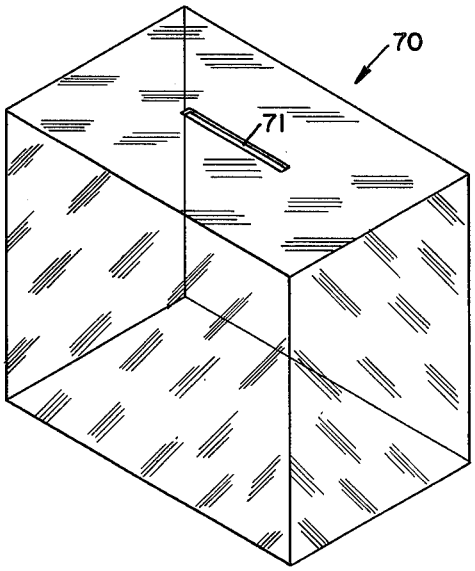
FIG. 7 is a perspective view of a cover for the cup caddy shown in FIG. 8.
Figure 8:
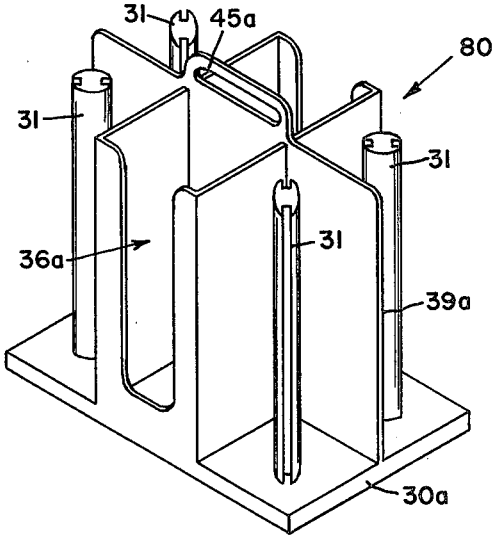
FIG. 8 is a perspective view of a cup caddy in accordance with another embodiment of the invention.

FIG. 7 shows another dust cover for use with the cup caddy 80 of FIG. 8. The cover 70 includes a slotted opening 71 of a size to receive the handle **45*a*. Thus, since the cup caddy 80 includes four posts 31 instead of one post 31, the capacity of the cup caddy 80 is increased by a factor of four for the cup holders 11 and is increased by a factor of two for the cup refill 12, since there are two refill container means 36*a***.

Figure 10:
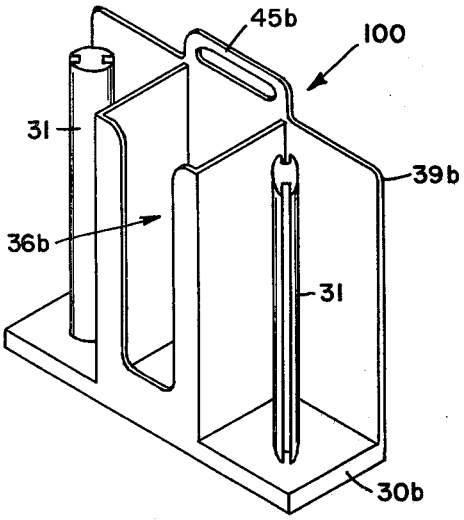
FIG. 10 is a perspective view of a cup caddy in accordance with yet another embodiment of the invention.
Figure 11:
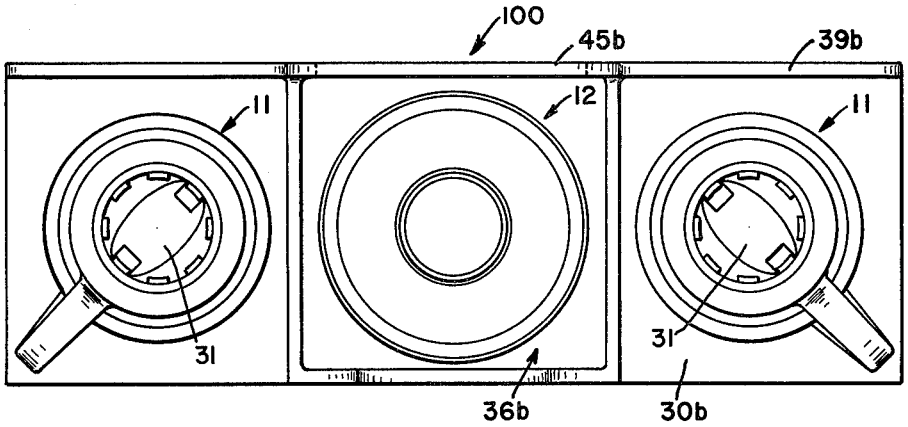
FIG. 11 is a top view of the cup caddy of FIG. 10.
Figure 12:
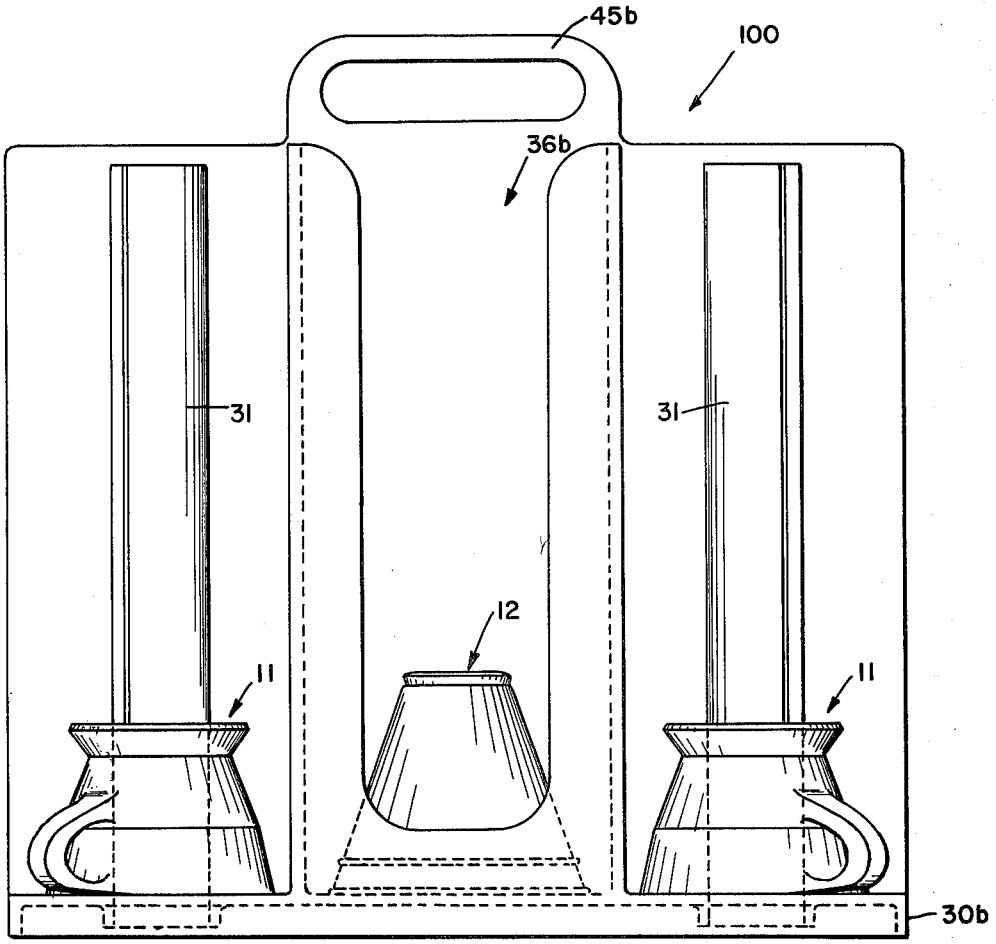
FIG. 12 is a front view of the cup caddy of FIG. 10 showing cup holders and refills stacked in accordance with the invention.

Referring now to FIGS. 10, 11 and 12, another cup caddy 100 is shown. The cup caddy 100 is similar to the cup caddy 10 except that it includes an additional post 31 for the additional storage of cup holders 11 thereon. The cup caddy 100 includes a larger base **30*b* for two posts 31. Interposed between the two posts 31 is a refill container means 36*b* similar to the refill container means 36 for the storage of cup refills 12. A handle 45*b* is placed on a rear wall 39*b* at a balancing point between the two posts 31. The cup caddy 100 operates in the same manner as the cup caddy, except that it has the additional capacity for holding additional cup holders 11 on the post 31. The cover 46 may be used in combination with the cup caddy 100** as previously described.

Having thus described several forms in which the invention may be practiced, it will be evident that other modifications and improvements might be made by one skilled in the art which would come within the scope of the annexed claims.

What is claimed as new and desired to be secured by Letters Patent of the United States is:

1. A cup caddy for cup holders and cup refills of the type which are each mateable along a given cup axis to form a drinking cup, said cup caddy comprising:

(a) a base, (b) a vertical post mounted on said base for stacking a plurality of said cup holders thereon along said given cup axis when said cup holders have a through-opening coaxial with said cup axis, (i) said vertical post includes at least one keyway along its length, (c) each of said cup holders includes at least one key fixed in said through-opening and being in mateable cooperative relationship with said keyway for aligning said cup holder on said post, and (d) a refill means mounted on said base for containing a plurality of cup refills in stacked relationship along a vertical axis corresponding to said cup axis, (i) said refill means having an oblong recess communicating with said plurality of cup refills for providing an access to said cup refills along said vertical axis, (ii) said refill means being proximal to said post.

2. The invention defined in claim 1 further including a rigid handle fixed in cooperative relationship to said refill means for carrying said cup caddy without obstructing access to said cup holders on said post and said cup refills in said refill means.

3. A cup caddy for cup holders and cup refills of the type which are each mateable along a give cup axis to form a drinking cup, said cup caddy comprising:

(a) a base, (b) a vertical post mounted on said base for stacking a plurality of said cup holders thereon along said given cup axis when said cup holders have a through-opening coaxial with said cup axis, (i) said post includes two oppositely disposed keyways along the length of said post, (c) each of said cup holders includes two oppositely disposed keys fixed in said through-opening and being in mateable cooperative relationship with said two keyways for aligning said cup holders on said post, and (d) a refill means mounted on said base for containing a plurality of cup refills in stacked relationship along a vertical axis corresponding to said cup axis,
(i) said refill means having an oblong recess communicating with said plurality of cup refills for providing an access to said cup refills along said vertical axis,
(ii) said refill means being proximal to said post.

4. The invention defined in claim 3 wherein said post has a reduced cross-sectional area between said oppositely disposed keyways.

5. In combination with a cup refill and a cup holder having a handle and a recessed through-opening along a cup axis for holding said cup refill therein, said cup holder including at least one key internally disposed in said recessed through-opening, a cup caddy comprising:
(a) a base,
(b) a post vertically mounted on said base for stacking said cup holders thereon along said cup axis,
(i) said post includes at least one keyway upon which said cup holder is alignable thereon,
(c) refill container means mounted on said base for containing a plurality of cup refills therein in nesting relationship along a vertical axis,
(i) said refill container means including a wall having a recess positioned in cooperative relationship with said vertical axis so that said cup holder handle is movable therein when said cup holder is disposed over said plurality of refills in said refill container means.

6. In combination with a cup refill and a cup holder having a handle and a recessed through-opening along a cup axis for holding said cup refill therein, said cup holder including two opposed keys internally disposed in said recessed through-opening, a cup caddy comprising:
(a) a base,
(b) a post vertically mounted on said base for stacking said cup holders thereon along said cup axis,
(i) said post includes two oppositely disposed keyways for receiving said keys therein for aligning all of said cup holders thereon,
(c) refill container means mounted on said base for containing a plurality of cup refills therein in nesting relationship along a vertical axis,
(i) said refill container means including a wall having a recess positioned in cooperative relationship with said vertical axis so that said cup holder handle is movable therein when said cup holder is disposed over said plurality of refills in said refill container means.

* * * * *